US006039612A

United States Patent [19]

Brown et al.

[11] Patent Number: 6,039,612

[45] Date of Patent: Mar. 21, 2000

[54] ARRANGEMENT FOR MOUNTING TERMINAL BLOCKS IN A MOUNTING PANEL

[75] Inventors: Jack L. Brown, Hendersonville; Rodney William Bruner, Fletcher; Neal Edward Rowe, Asheville; William Edward Wilkie, II, Fletcher; Robert Yanniello, Asheville, all of N.C.

[73] Assignee: Eaton Corporation, Cleveland, Ohio

[21] Appl. No.: 09/261,796

[22] Filed: Mar. 3, 1999

[51] Int. Cl.[7] ..... H01R 9/26

[52] U.S. Cl. ..... 439/716; 439/545; 439/571; 439/572; 439/540.1

[58] Field of Search ..... 439/716, 571, 439/545, 540.1, 572; 335/132, 8; 200/307

[56] References Cited

U.S. PATENT DOCUMENTS 4,345,225 8/1982 Lemmer ..... 335/132
4,595,812 6/1986 Tamaru et al. ..... 200/307
4,958,135 9/1990 Baginski et al. ..... 335/8
5,508,891 4/1996 Rowe et al. ..... 361/833
5,764,490 6/1998 Barbier et al. ..... 439/716 R

*Primary Examiner*—Steven L. Stephan
*Assistant Examiner*—Son V. Nguyen
*Attorney, Agent, or Firm*—Martin J. Moran

[57] ABSTRACT

A flexible arrangement for providing secondary terminations, such as for switchgear in electric power distribution systems, includes a plurality of molded blocks each having at least one pair of oppositely directed hooks extending from a rear face. The hooks pass through complimentary notches in a mounting slot in a mounting panel, and engage the mounting panel with the molded blocks displaced along the mounting slot so that the hooks are out of registration with the notches. A locking member blocks the realignment of the hooks with the notches. Molded filler blocks without the terminal members can be substituted for one or more molded terminal blocks when fewer terminations are needed. There filler blocks have hand grips such as preferably a longitudinal rib molded on a front face, for inserting and removing the filler block from the slot.

14 Claims, 2 Drawing Sheets

ARRANGEMENT FOR MOUNTING TERMINAL BLOCKS IN A MOUNTING PANEL

BACKGROUND OF THE INVENTION

1. Field of the Invention

This invention relates to a flexible arrangement for mounting electrical terminal blocks in a mounting panel, and has particular application to such an arrangement for mounting secondary terminal blocks in electrical power distribution system switchgear assemblies.

2. Background Information

Terminal blocks are used to make connections in electrical wiring. One application where terminal blocks are used is in switchgear for electric power distribution systems. Switchgear includes electrical switching apparatus, such as for example circuit breakers, mounted in metal cabinets together with buses which connect the switching devices into the distribution system. These buses constitute the primary conductors of the switchgear. Wiring for control and monitoring of the switchgear is referred to as secondary wiring. Terminations are provided for connecting the secondary wiring to wiring extending out of the switchgear such as to a remote panel. Typically, the terminations are mounted on molded electrically insulated terminal blocks which are commonly secured to the switchgear cabinet by screws.

The number of secondary terminations required varies with the installation. It is wasteful and costly to provide all installations with the maximum number of secondary terminations.

There is a need, therefore, for an arrangement for providing just the number of secondary terminations needed in a particular installation.

There is a related need for providing this flexibility without requiring custom installation.

There is also a need for an arrangement providing such flexibility in which the required number of terminations can be easily and quickly installed and/or removed without the need for special tools.

SUMMARY OF THE INVENTION

These needs and others are satisfied by the invention which is directed to apparatus which includes at least one molded block supporting electrical terminations and having a pair of spaced, oppositely directed hooks extending rearward therefrom. The apparatus also includes a mounting panel having an elongated slot with a pair of notches extending laterally which are spaced and shaped for the pair of hooks on the molded block to pass through and engage the mounting panel with the block displaced along the elongated slot so that the hooks are out of registration with the notches. Preferably, the molded block has at least two pairs of oppositely directed hooks spaced longitudinally along the block and the elongated slot in the mounting panel has corresponding pairs of notches through which the pairs of hooks may pass for engaging the pairs of hooks as the molded block is slid along the slot.

In the preferred arrangement, the elongated slot has a sufficient length to accommodate a plurality of the molded blocks, one or more of which can be filler blocks without electrical terminations. The elongated slot may have pairs of notches accommodating the pairs of hooks on the backs of the plurality of molded blocks. The elongated slot is of such a length that the plurality of blocks fill up the slot except for a gap produced when the blocks are slid out of registration with the notches. A locking member engages the gap in the slot to block realignment of the hooks on the molded blocks with the notches in the slots so that the molded blocks cannot be removed without removal of the locking member.

Preferably, the filler blocks have hand grips on a front face by which they can be gripped for installation and removal and for sliding them along the mounting slot. In the most preferred embodiment of the invention, the hand grip is in the form of an integrally molded longitudinal rib on the front face of the molded filler block.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
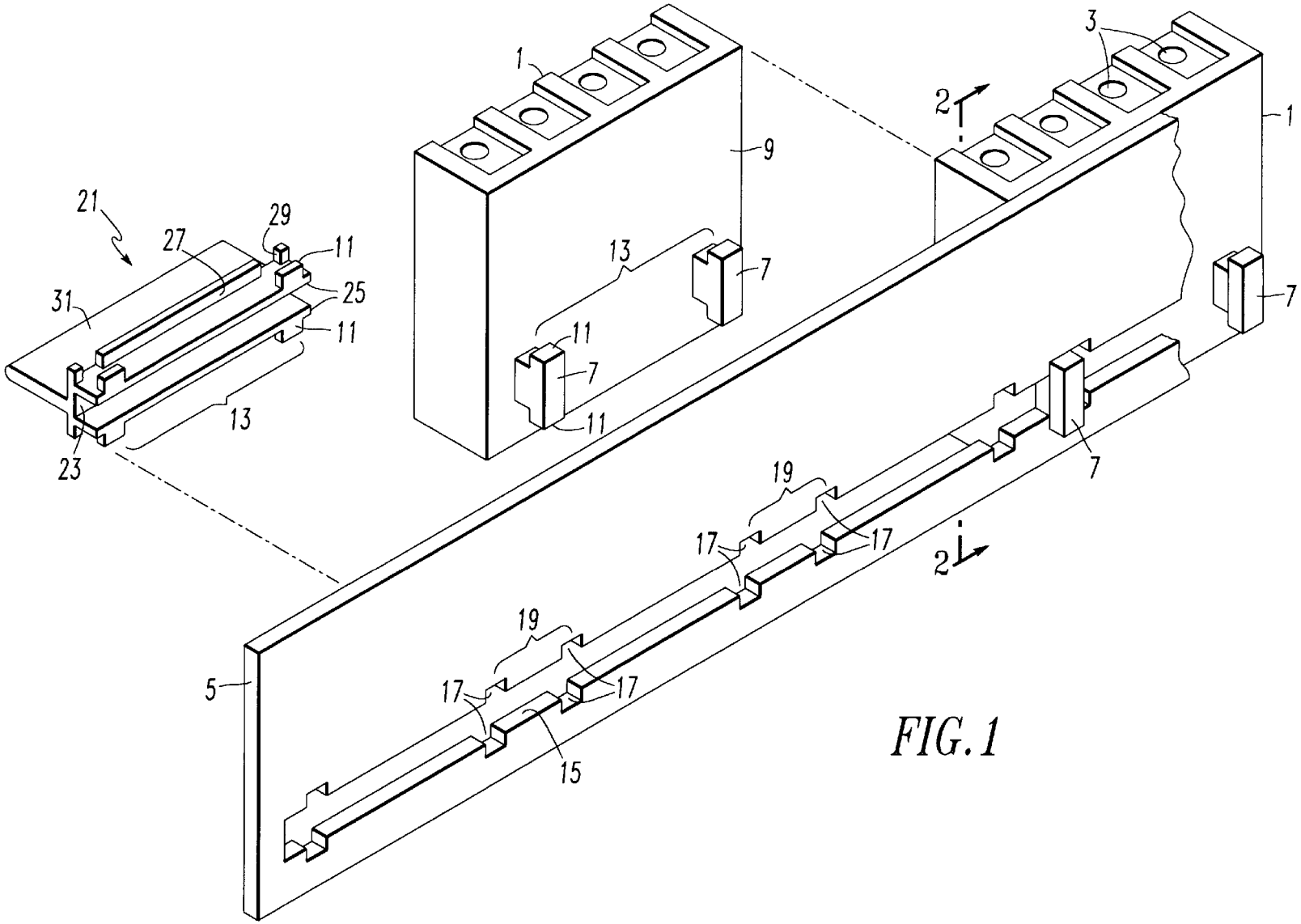
FIG. 1 is a partially exploded rear isometric view of apparatus in accordance with the invention including a mounting panel, terminal blocks and a filler terminal block.

As shown in the drawings, the invention is directed to the apparatus for mounting variable numbers of terminal blocks such as the terminal blocks used for terminating the secondary wiring in switchgear. Depending upon options selected for the switchgear, the number of secondary terminations can vary. The invention makes it possible to easily vary the number of terminations without requiring customization.

The secondary terminations are provided on terminal blocks 1 which are typically molded of an electrically insulative resin. A number of terminal members 3 are supported in spaced relation on the molded terminal blocks 1. The number of terminal blocks 1 used is dependent upon the number of terminal members 3 needed in a particular installation.

Figure 2:
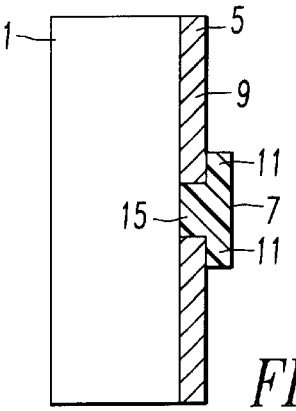
FIG. 2 is a vertical section through the assembly of FIG. 1 taken along the line 2—2.

The terminal blocks 1 are supported in the switchgear (not shown) by a mounting panel 5. For this purpose, the molded terminal blocks 1 have mounting members 7 integrally molded on a rear face 9 as shown in FIGS. 1 and 2. The integral T-shaped mounting members 7 project rearwardly from the rear face 9 to form a pair of oppositely directed hooks 11. Preferably, there are two sets 13 of oppositely directed pairs of hooks 11, integrally molded on the rear face 9 of each of the molded terminal members. The two sets 13 of pairs of hook are spaced a standardized distance apart on the rear face 9.

The mounting panel 5 has an elongated slot 15 with lateral extensions forming pairs of notches 17. The pairs of notches 17 are sized to allow a pair of hooks 11 to pass through. Two sets 19 of the pairs of notches 17 are spaced apart the same distance as the two sets of pairs of hooks 11 on the molded terminal blocks so that the sets 13 of pairs of hooks 11 on a terminal block can be simultaneously passed through a corresponding set 19 of pairs of notches 17 on the mounting panel 5. With the pairs of hooks 11 then behind the mounting panel, the terminal block I is slid axially along the slot 15 so that the hooks 11 are out of registration with the notches 17. With the hooks 11 thus firmly engaged in the slot 15, the terminal block is securely mounted. It will be appreciated that a single set 19 of two of the pairs of notches 17 could be used to mount any number of terminal blocks depending upon the length of the slot 15. However, in the preferred embodiment of the invention more than one set 19 of the pairs of notches 17 is provided and most preferably such a set 19 of pairs of notches 17 is provided for each of the positions for mounting a terminal block on slot 15. With this arrangement any particular block can be removed or a block can be put into any particular position without need to remove other terminal blocks.

In the exemplary embodiment of the invention, four terminal blocks 1 can be supported by the mounting panel 5. This number is for illustrative purposes only, and the slot 15 can be made long enough to accommodate any desired maximum number of terminal blocks. In any event, there can be applications where fewer than the maximum number of terminal blocks is required. While an unused terminal block could be inserted to fill the slot 15, it is preferred in accordance with the invention, to provide a filler terminal block 21. The filler terminal block 21 is preferably molded of an electrically insulative resin and has a planar body 23 with a pair of spaced apart flanges 25 extending along rear face 27 of the planar body 23. Oppositely directed integrally molded projections on the flanges form pairs of oppositely directed hooks 11. As in the case of the standard terminal blocks 1, the filler terminal block 21 has sets 13 of the oppositely directed pairs of hooks 11 spaced apart the same distance as between the sets 19 of pair of notches 17 in the slot 15. For ease of molding, slots 29 are aligned in the planar member with the hooks 11.

The filler block 21 has a hand grip 31 on a front face 33 of the planar member 23. Preferably, this hand grip 31 is in the form of an integrally molded longitudinally extending rib which aids in inserting and removing the filler block 21 in the mounting slot 15 of the mounting panel 5.

A filler terminal block 21 can be provided in any position along the slot 15 by inserting the hooks 11 through the appropriate set 19 of notches 17 and then sliding it longitudinally until the hooks 11 are out of registration with the notches 17.

Figure 3:
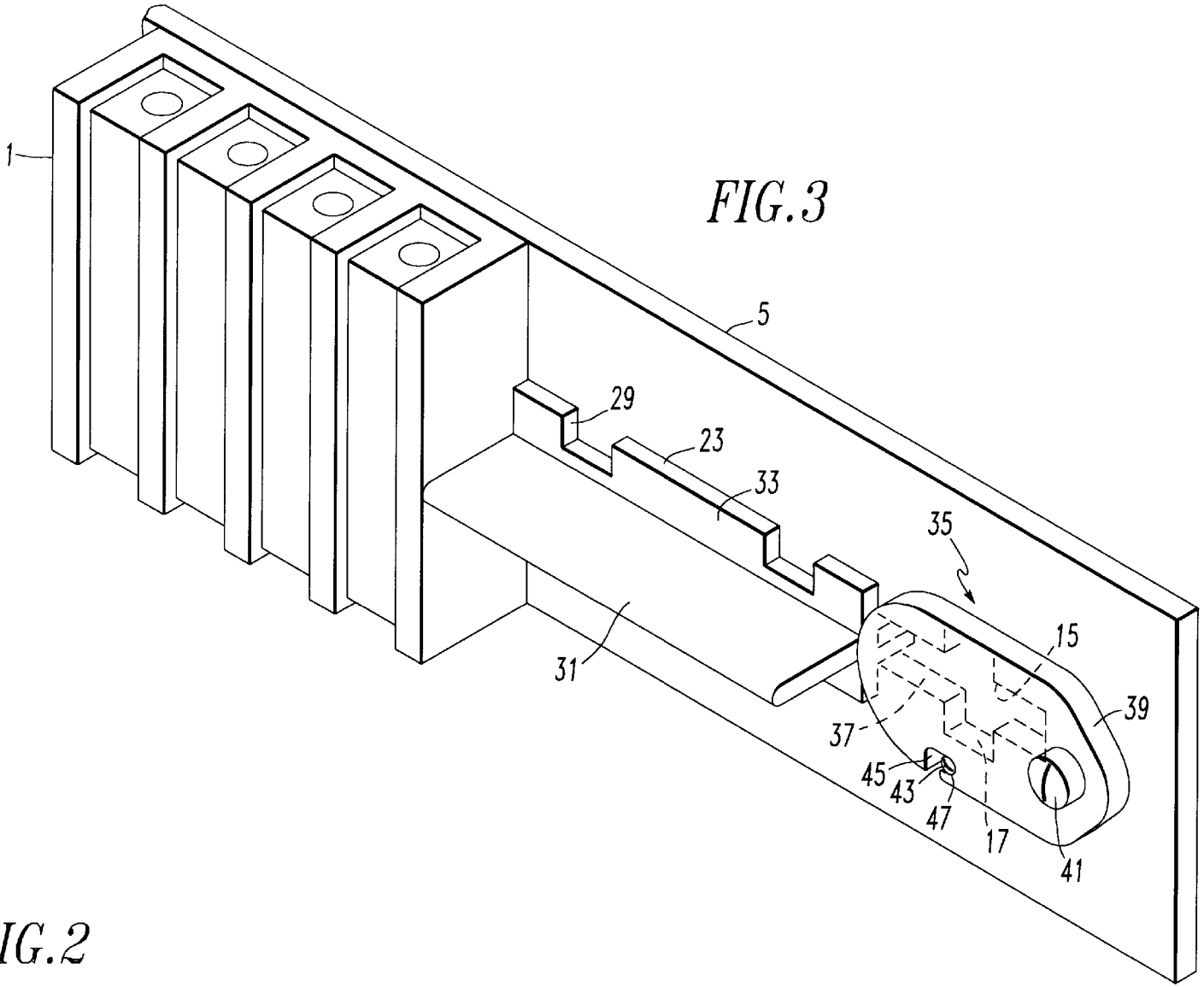
FIG. 3 is a front isometric view of the apparatus of the invention shown assembled.

In order to secure the terminal blocks, including one or more filler terminal blocks 21 in the slot 15 in the mounting panel 5, a locking device 35 is provided. This locking device blocks the gap 37 in the slot 15 created when the molded blocks are slid along the slot out of regulation with the notches 17. It prevents the terminal blocks 1, 21 from being slid along the mounting slot 15 to realign the hooks 11 with the slots 17. As shown in FIG. 3, the locking device 35 is in the form of a plate 39 which is pivotally mounted by a first screw 41 to the mounting panel so that it can be rotated to the position shown in full line in FIG. 3 where it overlaps the end of the slot 15 and blocks movement of the terminal blocks. The plate 39 can be maintained in this position by a second screw 43 which is engaged by a slot 45 in the plate. The slot 45 can have a detent 47 to the plate 39 retain in the blocking position. For removal or installation of molded blocks, the locking plate 39 is rotated so that it is clear of the mounting slot 15 as shown in phantom line in FIG. 3. Alternative locking devices could be used, such as for example a spring clip (not shown) that engages the slot and/or the notches 15 to block registration of the hooks 11 of the terminal blocks with the notches 17.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. Apparatus comprising:

at least one molded block supporting electrical terminal members, said at least one molded block having at least of pair of spaced, oppositely directed hooks extending rearwardly therefrom; and a mounting panel having therein an elongated mounting slot, said elongated mounting slot having at least a pair of lateral extensions forming notches spaced and sized for passage of said hooks therethrough for engaging said mounting panel with said at least one molded block displaced in said slot so that said hooks are out of registration with said notches.

2. The apparatus of claim 1 wherein said at least one molded block has a set of two longitudinally spaced pairs of oppositely directed hooks extending rearwardly therefrom and said elongated slot has at least one set of two longitudinally spaced pairs of notches through which said set of two longitudinally spaced pairs of hooks on said at least one molded block passes.

3. The apparatus of claim 1 including a locking member blocking said slot with said at least one molded block displaced longitudinally in said slot so that said at least one pair of hooks are out of registration with said at least one pair of notches for blocking movement of said at least one molded block to bring said at least one pair of hooks into registration with said at least one pair of notches.

4. The apparatus of claim 3 wherein said locking member comprises a pivotally mounted plate which is rotable into a blocking position blocking at least one of said slot and said notches.

5. The apparatus of claim 1 comprising a plurality of molded blocks at least some of which support the electrical terminal members and each having a pair of spaced oppositely directed hooks extending rearwardly therefrom, and wherein said elongated slot is of sufficient length to receive said plurality of molded blocks.

6. The apparatus of claim 5 wherein said plurality of molded blocks includes at least one filler block without the electrical terminal members.

7. The apparatus of claim 6 wherein said at least one filler block has an integral grip member molded into a front face.

8. The apparatus of claim 7 wherein said grip member comprises a longitudinal rib on said front face of said at least one filler block.

9. The apparatus of claim 5 wherein said elongated slot includes at least a pair of notches for receiving said at least one pair of hooks on each of said plurality of molded blocks.

10. The apparatus of claim 9 wherein each of said molded blocks has two longitudinally spaced pairs of hooks and said elongated slot has a set of two of said pairs of notches for receiving said set of two pairs of hooks on each of said plurality of molded blocks.

11. The apparatus of claim 10 wherein said plurality of molded blocks includes at least one filler block without electrical terminal members, said plurality of molded blocks being sized to substantially fill said elongated slot except for a gap left by sliding said molded blocks out of registration with said notches.

12. The apparatus of claim 11 including a locking member engaging said gap in said slot to prevent sliding of said molded blocks into registration with said notches.

13. The apparatus of claim 12 wherein said at least one filler block has a grip member integrally formed on a front face thereof.

14. The apparatus of claim 5 wherein said plurality of molded blocks substantially fill said elongated slot except for a gap left by sliding said molded blocks out of registration with said notches, and including a locking member which blocks said gap in said slot to block sliding of said molded blocks in said elongated slot to bring said hooks into engagement with said notches.

* * * * *